United States Patent [19]

Gammill

[11] Patent Number: 4,852,336

[45] Date of Patent: Aug. 1, 1989

[54] HALTER WITH POP-RELEASE FASTENER MEANS

[76] Inventor: Floyd M. Gammill, 3489 Locker Rd. SE., Port Orchard, Wash. 98366

[21] Appl. No.: 129,787

[22] Filed: Dec. 7, 1987

[51] Int. Cl.[4] ..... B68B 1/02

[52] U.S. Cl. ..... 54/24

[58] Field of Search ..... 54/6 R, 6 A, 24; 119/96, 106; 24/200

[56] References Cited

U.S. PATENT DOCUMENTS

| | | | |
|---|---|---|---|
| 977,404 | 11/1910 | Humphrey | 24/200 X |
| 1,939,107 | 12/1933 | Crandall | 54/24 |
| 2,526,140 | 10/1950 | Keyston | 54/24 |
| 2,932,930 | 4/1960 | Ray | 54/24 |
| 3,418,787 | 12/1968 | Smith | 54/24 |

FOREIGN PATENT DOCUMENTS

| | | | |
|---|---|---|---|
| 2002445 | 2/1979 | United Kingdom | 24/165 |

*Primary Examiner*—Robert P. Swiatek

*Attorney, Agent, or Firm*—Christopher Duffy

[57] ABSTRACT

The fastener is located in the loop of strap material which encircles the animal's poll, and includes a pair of relatively reciprocable male/female fastener elements which are operable to close and open the loop when they engage and disengage with and from one another. In the engaged condition thereof, the fastener elements are interlocked against reciprocation by a latch which is manually releaseable; and each time the latch is released, there is a cam action generated by resiliency in the latch which has the effect of not only driving the fastener elements apart, but also ejecting or jettisoning one from the other into the open, ambient atmosphere about the animal.

21 Claims, 2 Drawing Sheets

HALTER WITH POP-RELEASE FASTENER MEANS

DESCRIPTION

TECHNICAL FIELD

This invention relates to a halter for use on the head of an animal, such as a horse, mule, or other equine or bovine animal whose body has a relatively angular head thereon, and ears adjacent the apex of the same.

BACKGROUND ART

In the case of such an animal, its head commonly comprises a snout which projects relatively forwardly of the ears, a poll which is disposed relatively behind the ears, and a jaw which interconnects the snout and the poll at the bight of the animal's head. A halter for the head of such an animal commonly comprises flexible strap material which is formed into a pair of first and second loops that are adapted to be encircled about the animal's snout and poll, respectively, and the second of which is alternately openable and closeable and operatively interconnected with the first loop, crosswise of the jaw, so that when the second loop is opened, the halter can be removed from the animal's head in the direction relatively forwardly of its snout. To facilitate opening and closing the second loop, the loop is commonly in two parts and closeable by fastener means which are positioned between the parts and manually releaseable so that the user can reopen the loop when he desires to remove the halter from the animal's head. Examples of two such halters can be seen in U.S. Pat. Nos. 2,099,398 and 3,566,454.

Halters equipped with manually releaseable fastener means such as those seen in the foregoing patents, have the shortcoming that the user must use both hands and allow considerable time to release the fastener means before he can separate the parts of the second loop and remove the halter from the animal's head. Moreover, the animal may not cooperate with him in the process, and in fact, the process itself may sufficiently disturb the animal that he will disrupt it by movements of his head, including movements upward of his poll, where the operation is taking place. These movements may also have the effect of raising the level of the animal's head and poll above the ground, so that the fastener means are even more difficult to reach from a standing position on the ground. On the other hand, if the animal's head is restrained by securing it to a point on the ground, such as to a tie rail thereabove, the animal's head movements may add considerable strain to the strap material of the second loop and prevent the user from releasing the fastener means, particularly if the operation has a step of providing slack in the second loop at the time the operation is conducted on the animal.

One object of the present invention is to provide a halter which is free from these shortcomings, and in particular, one which is equipped with fastener means that are self-operating once the user has actuated the operation by a simple touch of the hand, such as by a trigger-like touch with one or more fingers of the hand. More particularly, the invention has the object of providing a halter which is equipped with fastener means that literally explosively disengage or "pop" apart from one another once the operation has been triggered by the user's hand. In this way, the user need only trigger the operation with that hand, and his other hand is free to assume a different position, such as one in which it is used to restrain the animal, for example, by means of a lead line attached to the first loop of the halter. In fact, the user can also use this latter hand to effectively "snatch" the halter from the animal's head at the same time as he uses his first hand to trigger the release of the fastener means. As a consequence, the halter can be effectively removed from the animal's head in a moment's time before the animal is even aware of what the user has in mind for him.

The invention also has the related object of providing a halter which is equipped with means whereby the second loop can be infinitely adjusted in circumferential length, and cinched about the animal's poll without the necessity for unfastening anything to do so. More particularly, the invention has the object of providing an elongated strip of strap material in the second loop which is continuous and uninterrupted circumferentially of the loop, yet capable of being adjusted circumferentially of the loop to assume an infinite number of lengths within the loop. In this way, there is no need for a joint within the strip at which to make an adjustment in its length, and no need for extra strap material with which to make the adjustment at the joint. Nor is there any need for holes or the like in the strap material with which to make the joint, such as is the case with a conventional pin and hole buckle joint. In fact, the strip can lie flat and unbroken on the animal's poll, such as over the flanks of the same, and after it has been cinched up, it will present no free end to flap about and distract the animal, nor anything to snag on objects external of the animal, nor anything he can use as a means for loosening the loop, nor anything that will fray and tear because of the existence of holes or some other break in the continuity of the strap material.

DISCLOSURE OF THE INVENTION

According to the invention, these and other objects are achieved by a halter of my discovery wherein the fastener means employed in the second loop include a pair of male/female fastener elements which are reciprocable in relation to one another, circumferentially of the second loop, to and from a first point therein, and cooperatively engageable and disengageable with and from one another, to close and open the second loop, respectively, when the elements are reciprocated in relation to one another over that portion of the second loop extending between the aforesaid first point therein, and a second point therein, spaced apart from the first point, circumferentially of the second loop. There are also manually releaseable latch means in the second loop which are operable to interlock the fastener elements against reciprocation in relation to one another when the elements engage with one another at the second point in the second loop. Moreover, there are drive means including yieldable biasing means which are responsive to release of the latch means at the second point in the second loop to reciprocate the fastener elements in relation to one another from the second point to the first point in the second loop, to open the second loop.

In the presently preferred embodiments of the invention, there are also means in the second loop for accelerating the rate of relative reciprocation between the fastener elements, when they reciprocate in relation to one another from the second point to the first point in the second loop, so that one fastener element is ejected or jettisoned from the other, into the open, ambient atmosphere of the halter, when the fastener elements disengage from one another at the first point in the second loop. In this way, the user need only manually release the latch means, such as with the touch of one hand, and the drive means will produce a spontaneous separation between the fastener elements, spatially of the halter, so that the halter can be removed from the animal's head in a simultaneous movement on the part of the user's other hand, if he desires. Furthermore, this other hand may be used to restrain the animal while the fastener means are triggered by the first hand, if the user desires. That is, the user may take hold of the first loop with one hand, for example, by means of a lead line attached thereto, and while he restrains the animal with that hand, he can use the other to trigger the fastener means and, simultaneously, "snatch" the halter from the animal's head with his one hand, for example, by applying a pulling force on the lead line, relatively forward of the animal's snout.

In certain of the presently preferred embodiments of the invention, the latch means include a pair of latch elements which are disposed on the relatively forward end portion of the male fastener element and retractable against the bias of the biasing means when the fastener elements engage one another at the first point in the second loop. The latch means also include catch means on the female fastener element with which the latch elements are engageable under the bias of the biasing means, to interlock the fastener elements against reciprocation in relation to one another, when the fastener elements engage one another at the second point in the second loop. The latch elements and the female fastener element have cooperatively engageable cam means thereon which are responsive to release of the latch means at the second point in the second loop, to reciprocate the fastener elements in relation to one another from the second point to the first point in the second loop, under the bias of the biasing means. The cam means, in turn, have associated propulsion means for accelerating the reciprocation of the fastener elements in relation to one another when the fastener elements disengage from one another at the first point in the second loop, so that one fastener element is ejected from the other into the open, ambient atmosphere of the halter, to totally detach the elements from one another about the animal's poll.

In some of the presently preferred embodiments of the invention, the male fastener element defines a pair of detents which are resiliently displaceable crosswise the circumference of the second loop, adjacent the forward end of the male fastener element, and the female fastener element defines a socket for receiving the detents, circumferentially of the second loop. The socket and detents have cooperatively engageable cam surfaces thereon, which are angularly related to one another and responsive to release of the latch means to reciprocate the fastener elements in relation to one another, from the second point to the first point in the second loop. Meanwhile, the angle between the surfaces is increased as the elements approach the first point in the second loop, so that one fastener element is ejected from the other when the fastener elements disengage from one another at the first point in the second loop.

In many of these latter embodiments, the socket is adapted to displace the detents against the resiliency thereof when the fastener elements engage one another at the first point in the second loop, but the socket has a pair of recesses in the cavity thereof for receiving the detents under the resiliency thereof when the fastener elements engage one another at the second point in the second loop.

Preferably, the female fastener element has openings therein whereby the latch means are releaseable by the application of direct manual force to the same through the openings. For example, in those embodiments employing the aforementioned latch elements, the latch elements are accessible through the openings of the female fastener element, so that manual force can be directly applied to the same when the latch means are to be released to open the second loop.

In one group of presently preferred embodiments, the respective male/female fastener elements have a tenon and mortise on the relatively forward end portions thereof, and the tenon and mortise are cooperatively engageable and disengageable with and from one another when the fastener elements are reciprocated in relation to one another over the aforesaid portion of the second loop. The latch elements are disposed on the tenon, at opposite sides thereof, and the mortise has opposing slots in the wall thereof with which the latch elements engage when the fastener elements engage with one another at the second point in the second loop. In certain embodiments, the slots are deeply recessed to accommodate the thumb and forefinger of one hand, so that the latch elements can be displaced against the bias of the biasing means by pinching the latch elements together with the thumb and forefinger of the one hand.

In many of those embodiments employing a tenon and mortise, the tenon is bifurcated into a pair of elongated, spaced parallel arms, which are resiliently flexible over the length thereof, and have outturned dogs on the relatively forward end portions thereof. The dogs, in turn, are curved at the outside edges thereof, to react with the wall of the mortise under the resiliency of the arms, and the curvature of the edges increases as the dogs progress toward the forward ends of the arms, to accelerate the rate of relative reciprocation between the fastener elements as they disengage from one another at the first point in the second loop.

Preferably, the fastener means are operatively disposed in the second loop on one flank of the animal's poll.

As indicated, another object of the invention is to equip the halter with means whereby the second loop can be infinitely adjusted in circumferential length and cinched about the animal's poll without the necessity for unfastening anything to do so. This being the case, in many of the presently preferred embodiments of the invention, one part of the second loop has means therein defining a pivot rung, and an elongated strip of strap material there adjacent, the main body of which is continuous and uninterrupted circumferentially of the second loop, but has one end portion thereof roved pivotally about the rung of the one part, and then folded reentrantly to a point intermediate the length of the strip. A three-rung slip fastener ring is slideably engaged on the main body of the strip, intermediate the length thereof, and there is an eye on the end portion of the strip which is pivotally mounted about the center rung of the fastener ring. The strap material of the strip is woven in serpentine fashion through the ring to capture the eye between the center rung and the interwoven portion of the strap material, so that each time the ring is slid along the length of the strip to a new site thereon, the eye is clamped between the strip and the center rung of the ring when tension is reapplied to the second loop in cinching the loop about the animal's poll.

BRIEF DESCRIPTION OF THE DRAWINGS

These features will be better understood by reference to the accompanying drawings, wherein the invention is illustrated in presently-preferred form by applying it to a halter for a horse.

In the drawings.

BEST MODE FOR CARRYING OUT THE INVENTION

Figures 1, 3, 5:
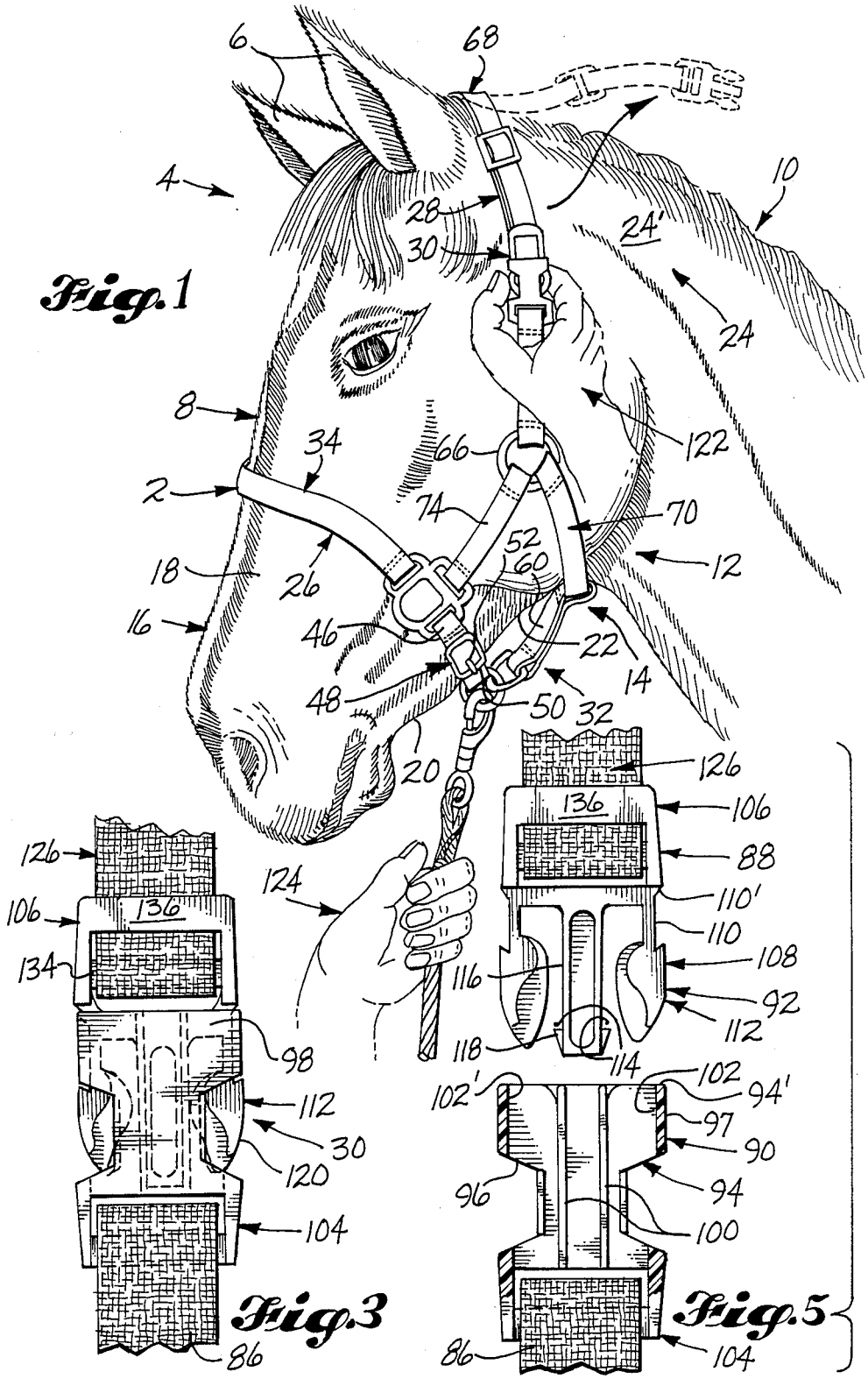
FIG. 1 is a perspective view of the horse's head when the halter has been mounted on the same, but the user has decided to remove the halter and has placed his hands in position to do so, by releasing the fastener means with one hand while he restrains the horse with the other, using a lead line attached to the forward end of the halter.
FIG. 3 is a plan view of the fastener means per se, when the fastener elements of the same are fully engaged with one another.
FIG. 5 is a third such view of the fastener means when the fastener elements are totally disengaged from one another.

Referring to the drawings, it will be seen that the halter 2 is specially adapted to be used on a horse's head 4. Like other equine or bovine animals, the horse has a relatively angular head 4, and ears 6 adjacent the apex of the same. Were it a bovine animal, it might also have horns (not shown). In any event, its head 4 comprises a snout 8 which projects relatively forwardly of the ears 6, a poll 10 which is disposed relatively behind the ears, and a jaw 12 which interconnects the snout 8 and poll 10 at the bight 14 of its head. In addition, at the forward end portion of the snout 8, the horse has a nose 16, and its nose in turn has a muzzle 18 and chin 20. At the underside of its jaw 12, it has a throat 22. The horse's poll 10 also has right- and left-hand flanks 24 thereon, but only the left-hand flank 24' an be seen in FIG. 1.

The halter 2 comprises a pair of interconnected loops 26 and 28 of flexible strap material. The pair of loops is adapted to be encircled about the horse's head, and the first or more forward of them, 26, is adapted to be encircled about the horse's snout 8, whereas the second or more rearward, 28, is adapted to be encircled about its poll 10. The halter 2 also comprises manually releasable "pop" fastener means 30 which are operatively disposed within the second or more rearward loop 28, so as to enable that loop to be conveniently opened and closed for encirclement about the poll of the horse, and then reopened for removal from the poll when the halter as a whole is removed from the horse. Toward this same end, moreover, the loops 26 and 28 are operatively interconnected with one another at 32, crosswise the jaw 12 of the horse's head, so that when the second loop 28 is reopened, the halter can be removed from the horse's head in the direction relatively forward of its snout 8, by the step of pulling on the halter at the more forward loop 26 therein, as shall be explained.

More specifically, the first or more forward loop 26 comprises a noseband 34 which is made up, in turn, from a pair of squares 36 and a pair of interconnecting straps 38 and 40. In use, one strap, 38, passes below the chin 20 of the horse, and the other strap, 40, passes over its muzzle 18. The squares 36 have cleats 42 on the top, bottom and rearward sides thereof, and the chin strap 38 and muzzle strap 40 are connected by eyes 43 to the pairs of cleats 42 at the top and bottom of the squares 36. The chin strap 38 is shaped, moreover, into two portions, 44 and 46, and the two portions are adjustably interconnected with one another by a conventional pin and hole buckling device 48, incorporated into the strap 38. As is usual, the buckling device 48 is mounted on one portion 44 of the strap, and equipped with a pin 50 that is pivotally mounted to engage in a series of holes 52 in the remaining portion 46 of the strap. The holes 52 are disposed, in turn, on one side of a reentrant fold 54 in the latter portion 46, and a slip ring 56 is engaged about the fold to form a clasp for the same. A second ring 57 is also employed on the portion 44 to clasp any extra material at the end of the strap 38. In addition, an O-ring 58 is mounted on the chin strap 38 to slide freely along the length of the same, and to provide an attachment site for one component 60 of the connection 32 between the loops 26 and 28, as shall be explained. The O-ring 58 also provides an attachment site for a lead line 62 which is attached to the halter as a means of restraining the horse. The lead line is commonly attached by a spring-loaded closure hook 64 at the upper end of the line 62.

The second loop 28 comprises a pair of cheek rings 66, and a pair of interconnecting straps 68 and 70. One of the straps, 68, is commonly referred to as the "crown strap" and passes over the flanks 24 of the horse's poll 10. The other, 70, is commonly referred to as the "throat band" and passes under the throat 22 of the horse's head. Like the straps 38 and 40 of the noseband 34, the straps 68 and 70 of the second loop have eyes 72 formed on the opposing ends thereof, and the respective eyes 72 are pivotally engaged about the pair of cheek rings 66, in much the same manner as the eyes 43 of the noseband 34 are engaged about the top and bottom cleats 42 and squares 36.

The connection 32 between the loops 26 and 28 comprises three additional straps 74 and 60, commonly referred to as "bands." Two of the bands, 74, are interconnected between the rearwardly oriented cleats 42 of the squares 36, and points disposed on the cheek rings 66 of the second loop between the eyes 72 of the straps 68 and 70 of the second loop 28. The latter bands 74 are commonly referred to as "cheek bands," whereas the third and intermediate band is commonly referred to as a "throat connector." The cheek bands 74 are fixed in position on the loops 26 and 28, whereas the throat connector 60 is shiftable circumferentially of the two loops. This follows from the fact that the throat connector has an oversized eye 76 at the rear end thereof, which is freely slideable on the throat band 70 of the second loop; and a D-ring 78 trunnioned to the forward end thereof, which is interconnected with the O-ring 58 of the nose band, to enable the band 60 to shift circumferentally of the chin strap 38 with the O-ring.

The crown strap 68 is divided into two sections 80 and 82, circumferentially of the second loop, and the two sections are interconnected by the fastener means 30. One section 80 is longer than the other, and is equipped with a slip fastening device 84 by which the length of the same can be adjusted circumferentially of the second loop 28. Both sections 80 and 82 are equipped, moreover, with eyes 86 at the opposing ends thereof, and the eyes 86 are employed in attaching the sections to the cheek rings 66 of the second loop, as well as to the respective fastener elements 88 and 90 of the fastener means, as shall be explained.

Figures 2, 4:
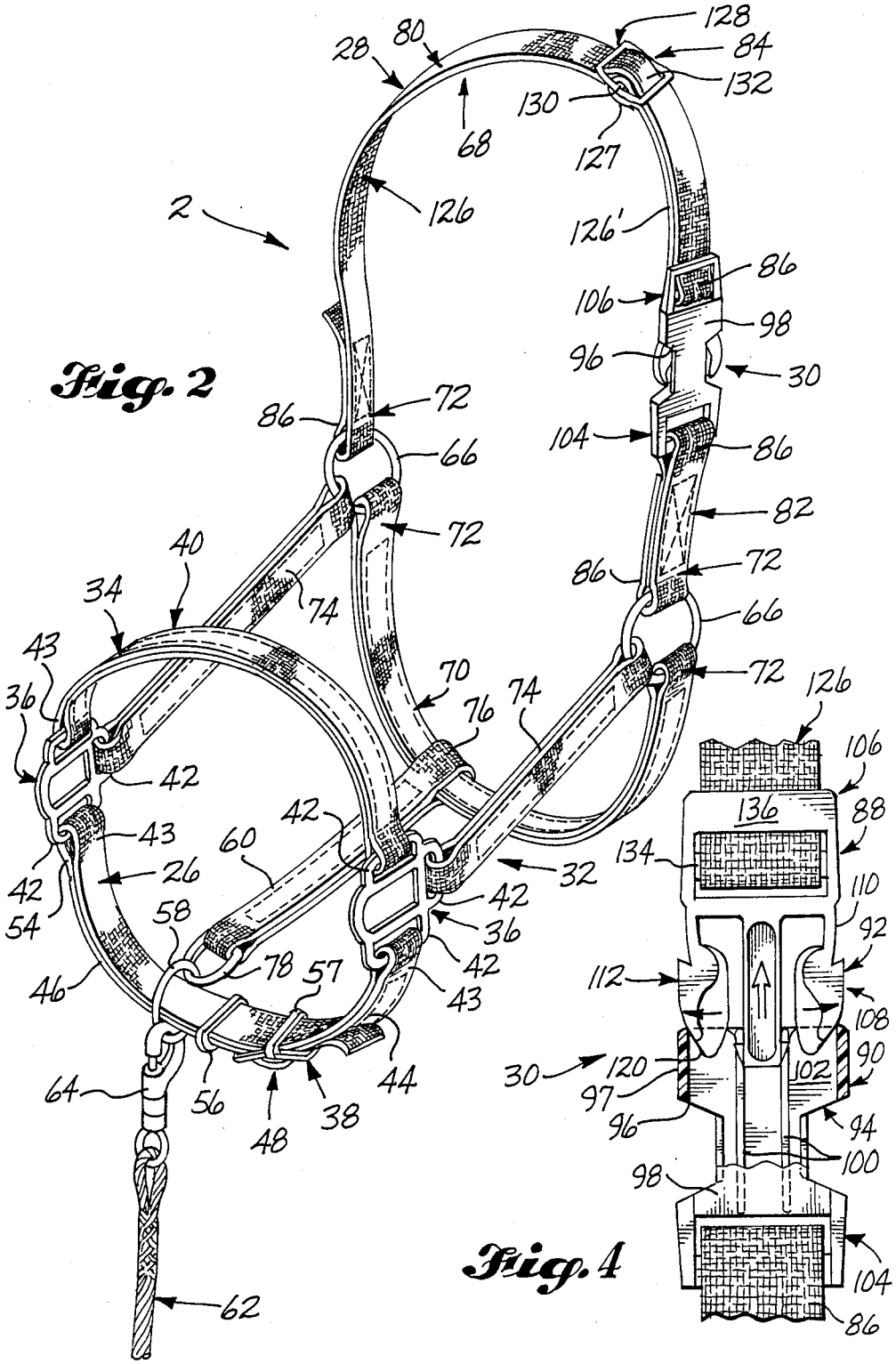
FIG. 2 is a perspective view of the halter and leadline per se, apart from the horse.
FIG. 4 is a similar view of the fastener means when the fastener elements are in the process of undergoing spontaneous ejection from one another.

Referring now to FIGS. 3 through 5, as well as FIGS. 1 and 2, it will be seen that the fastener elements 88 and 90 take the form of mating, flat, rectangular male/female fastener members, which define a tenon 92 and mortise 94, respectively, on the relatively forward end portions thereof. The mortise 94 is box-shaped, as well as flat, but after some distance, has a pair of laterally opposing slots 96 in the narrower sides 97 thereof, which open to the outside of the female member 90 and, in addition, are deeply recessed into the top and bottom walls 98 of the mortise, crosswise thereof. The mortise 94 also has a pair of spaced, parallel rails 100 on the inside thereof, which extend midway the cavity 102 of the same, circumferentially of the second loop. The rails 100, in turn, have opposing slots therein (not shown), which extend the full length thereof. At its rear end, moreover, the mortise has a D-ring 104 formed thereon, to which one eye 86 of the adjacent section 82 of the crown strap 68 is attached, as seen in FIG. 2. The tenon 92 also has a D-ring 106 formed thereon, and at its forward end, the tenon is larger in diameter than the mouth 102' of the mortise. The tenon is bifurcated, however, into a pair of spaced parallel arms 108, and the arms have wide, laterally opposing grooves 100 in the sides thereof, which form outturned dogs 112 on the forward ends thereof. The arms 108 are resiliently flexible over the length thereof, moreover, so that the dogs 112 are resiliently displaceable in the direction relatively toward one another, in the space 114 between the arms. As a result, the tenon 92 is insertable in the mortise, when the fastener members 88 and 90 are reciprocated in the direction relatively toward one another, circumferentially of the second loop. The arms 108 also have a rigid but hollow tongue 116 projecting midway between them, in the space 114 therebetween, and the tongue, in turn, has a pair of tapered lugs 118 on the forward end thereof. When the tenon 92 is insetted in the mortise, the tongue 116 slideably engages between the rails 100 of the mortise, while the lugs 118 slideably telescope in the slots (not shown) of the same. The tongue 116 and rails 100 thus provide a telescoping guide means for the tenon and mortise.

Though the tenon is insertable in the mortise, there is a yieldable bias against it doing so. The bias is generated by the laterally oriented edges 120 of the dogs 112 at the forward ends thereof, acting on the walls 97 of the mortise. As seen in FIGS. 3 through 5, the edges 120 are progressively curved axially inwardly of the tenon, as the dogs extend toward the mortise; and coupled with the resiliency of the arms 108, the edges and walls 97 interact with one another to generate a yieldably biasing force on the tenon in the direction relatively rearwardly thereof, that is, in the direction causing the fastener members 88 and 90 to separate from one another. Thus, when the tenon is inserted in the mortise, considerable force is required to overcome the cam action of the edges and walls, and permit the fastener members to interengage with one another. The bias is relieved, however, when the dogs come into registry with the slots 96 in the mortise. This follows from the fact that the sidewalls 97 of the mortise are sized in relation to the grooves 110 in the arms, and vice-versa, so that when the dogs come into registry with the slots, they are able to rotate relatively away from one another, into engagement with the slots, under the bias of the arms. At the same time, the shoulders 110' at the rear of the grooves 110 abut the rim 94' of the mortise, so that the fastener members are effectively interlocked against reciprocation in relation to one another, in either direction circumferentially of the second loop. Assuming, moreover, that the second loop is encircled about the poll of the horse at this time, the halter is effectively secured to the horse about its head, ready for use.

Subsequently, when the user decides to re-open the second loop, the cam action of the dogs 112 makes it possible for him to do so with no more participation on his part than unlatching the fastener members 88 and 90 at the dogs 112. Referring again to the slots 96 and the dogs 112 therein, it will be seen that the slots are open to the outside of the female fastener member 90, so that the dogs can be redisplaced relatively toward one another, for example, by pinching them together with the thumb and forefinger of one hand 122, as seen in FIG. 1. Moreover, the slots 96 are sufficiently recessed into the top and bottom of the mortise, crosswise thereof, that the thumb and forefinger can be used to realign the dogs with the cavity 102 of the mortise. And in addition, given the curved contact surfaces 120 for the thumb and forefinger, the displacement and realignment operation will also have the effect of reintroducing the dogs to the cavity of the mortise at the forward ends of the slots 96. At that point in the action, the resiliency in the arms 108 quickly takes over and creates the same biasing force on the tenon which the user had to overcome in interengaging the fastener members with one another at the beginning of the fastening operation. That is, the cam action of the edges 120 and walls 97 acts to bias the fastener members in the direction relatively away from one another, circumferentially of the second loop. At the same time, the curvature of the edges 120 increases dramatically as the members reciprocate in this direction, so that the action has the further effect of accelerating the rate of reciprocation between the members to the extent that one member is ejected or jettisoned from the other into the open, ambient atmosphere about the halter when the members disengage from one another at the mouth 102' of the mortise. As a consequence, to reopen the second loop, the user need only depress the dogs with his thumb and forefinger, and the rest of the operation thereafter is spontaneous and self-achieved.

Of course, the user need not be at eye level with the crown strap when he depresses the dogs. Nor need he lift the crown strap over the horse's ears, or do anything else to free the second loop from the horse's head. In fact, even a child whose height is well below that of the horse's head, can reach up and apply a pinching action to the dogs, to release them and open the second loop for removal of the halter from the horse.

Preferably, the fastener means 30 are disposed in the crown strap 68 at a site where the dogs 112 will be conveniently located on one flank 24' of the horse's poll 10 when the halter is secured about the horse's head. In fact, as seen in FIG. 1, the fastener means 30 may be disposed virtually at the bottom end of the crown strap, on that flank.

It is also apparent that since the user need only use one hand 122 to open the second loop, his other hand 124 is free to be used for other purposes. It may be used, for example, to restrain the horse's head, for example, at the lead line 62, while the user's first hand 122 is used to open the second loop.

The freeing up of one hand 124 also has the advantage that the user can use this additional hand to effectively "snatch" the halter 2 from the horse's head at the same time as he uses his two hands to restrain the horse and trigger the fastener means. That is, while he holds the lead line 62 with one hand, to restrain the horse, and uses the other 124 to trigger the fastener means 30, he can apply a slight forward and downward pull to the leadline, to "snatch" the halter from the horse's head, lengthwise of its snout, even before the horse realizes what he has in mind. In effect, then, he can remove the halter before the horse has an opportunity to disrupt the operation through the movement of his head.

In some instances, the insides of the dogs are relieved as shown to enable them to slideably insert in the slots (not shown) of the rails 100 when the dogs are displaced relatively toward one another in opening the second loop. However, given sufficient spacing between the dogs and the rails, this is not essential. Nor is it essential that the the rails 100 have slots for any purpose; nor that the tongue have lugs 118 on the same.

The drawings also illustrate a further feature of the invention whereby the second loop 28 can be infinitely adjusted in circumferential length, and cinched about the horse's poll 10 without the necessity for unfastening anything to do so. Referring to FIGS. 1 and 2 in particular, it will be seen that the longer section 80 of the crown strap 68 comprises an elongated strip 126 of strap material, the main body of which is continuous and uninterrupted circumferentially of the loop, but has one end portion 126' thereof received pivotally about the D-ring 106 on the male fastener member 88, and then folded reentrantly to a point intermediate the length of the strip. A three-rung slip fastener ring 128 is slideably engaged on the main body of the strip 126, intermediate the length thereof, and there is an eye 127 on the one end portion 126' of the strip which is pivotally mounted about the center rung 130 of the fastener ring. The strap material of the strip is woven in serpentine fashion through the ring 128 to capture the eye 127 between the center rung 130 and the interwoven portion 132 of the strap material, so that each time the ring 128 is slid along the length of the strip 26 to a new site thereon, the eye 127 is clamped between the strip and the center rung 130 of the ring when tension is reapplied to the second loop 28 in cinching the loop about the horse's poll 10.

Preferably, the strap material 126 is roved pivotally about a crossbar 134 in the D-ring 106 of the male fastener element, to enable the outlying bar 136 of the ring 106 to act as a clamp and flattener on the face of the strap 68. In this condition, the strap 68 is fixed in length and the horse can do nothing to dislodge it. Moreover, there is nothing to distract him, nor anything which the horse can rub against an object for purposes of dislodging the strap. Nor is there any opening or the like in the strap which can become frayed and worn so that the strap will fail prematurely.

I claim:

1. In a halter for an animal whose body has a relatively angular head thereon, and ears adjacent the apex of the same, the head comprising a snout which projects relatively forwardly of the ears, a poll which is disposed relatively behind the ears, and a jaw which interconnects the snout and poll at the bight of the animal's head, the halter comprising flexible strap material which is formed into a pair of first and second loops that are adapted to be encircled about the animal's snout and poll, respectively, the second loop being alternately openable and closeable and operatively interconnected with the first loop, crosswise of the jaw, so that when the second loop is opened, the halter can be removed from the animal's head in the direction relatively forwardly of its snout, and the second loop being in two parts and closeable by fastener means which are positioned between the parts and manually releaseable to reopen the loop when the user desires to remove the halter from the animal's head, the improvement wherein:

the fastener means include a pair of male/female fastener elements which are reciprocal in relation to one another, circumferentially of the second loop, to and from a first point therein, and cooperatively engageable an disengageable with and from one another, to close and open the second loop, respectively, when the elements are reciprocated in relation to one another over that portion of the second loop extending between the aforesaid first point therein, and a second point therein, spaced apart from the first point, circumferentially of the second loop, and there are manually releaseable latch means in the second loop which are operable to interlock the fastener elements against reciprocation in relation to one another when the elements engage with one another at the second point in the second loop, and drive means including yieldable biasing means which are responsive to release of the latch means at the second point in the second loop to reciprocate the fastener elements in relation to one another from the second point to the first point in the second loop, to open the second loop.

2. The halter according to claim 1 wherein there are also means in the second loop for accelerating the rate of relative reciprocation between the fastener elements, when they reciprocate in relation to one another from the second point to the first point in the second loop, so that one fastener element is ejected from the other, into the open, ambient atmosphere about the halter, when the fastener elements disengage from one another at the first point in the second loop.

3. The halter according to claim 1 wherein the latch means include a pair of latch elements which are disposed on the relatively forward end portion of the male fastener element and retractable against the bias of the biasing means when the fastener elements engage one another at the first point in the second loop, and catch means on the female fastener element with which the latch elements are engageable under the bias of the biasing means, to interlock the fastener elements against reciprocation in relation to one another, when the fastener elements engage one another at the second point in the second loop.

4. The halter according to claim 3 wherein the latch elements and the female fastener element have cooperatively engageable cam means thereon which are responsive to release of the latch means at the second point in the second loop, to reciprocate the fastener elements in relation to one another from the second point to the first point in the second loop, under the bias of the biasing means.

5. The halter according to claim 4 wherein the cam means have associated propulsion means for accelerating the reciprocation of the fastener elements in relation to one another when the fastener elements disengage from one another at the first point in the second loop, so that one fastener element is ejected from the other into the open, ambient atmosphere of the halter, to totally detach the elements from one another about the animal's poll.

6. The halter according to claim 1 wherein the male fastener element defines a pair of detents which are resiliently displaceable crosswise the circumference of the second loop, adjacent the forward end of the male fastener element, and the female fastener element defines a socket for receiving the detents, circumferentially of the second loop; and wherein the socket and detents have cooperatively engageable cam surfaces thereon which are angularly related to one another and responsive to release of the latch means to reciprocate the fastener elements in relation to one another, from the second point to the first point in the second loop, the angle between the surfaces being increased as the elements approach the first point in the second loop, so that one fastener element is ejected from the other when the fastener elements disengage from one another at the first point in the second loop.

7. The halter according to claim 6 wherein the socket is adapted to displace the detents against the resiliency thereof when the fastener elements engage one another at the first point in the second loop, but the socket has a pair of recesses in the cavity thereof for receiving the detents under the resiliency thereof when the fastener elements engage one another at the second point in the second loop.

8. The halter according to claim 1 wherein the female fastener element has openings therein whereby the latch means are releaseable by the application of direct manual force to the same through the openings.

9. The halter according to claim 8 wherein the latch means include a pair of latch elements which are disposed on the relatively forward end portion of the male fastener element and retractable against the bias of the biasing means when the fastener elements engage one another at the first point in the second loop, and catch means on the female fastener element with which the latch elements are engageable under the bias of the biasing means, to interlock the fastener elements against reciprocation in relation to one another, when the fastener elements engage one another at the second point in the second loop; and wherein the latch elements are accessible through the openings of the female fastener element, so that manual force can be directly applied to the same when the latch means are to be released to open the second loop.

10. The halter according to claim 9 wherein the respective male/female fastener elements have a tenon and mortise on the relatively forward end portions thereof, and the tenon and mortise are cooperatively engageable and disengageable with and from one another when the fastener elements are reciprocated in relation to one another over the aforesaid portion of the second loop; and wherein the latch elements are disposed on the tenon, at opposite sides thereof, and the mortise has opposing slots in the wall thereof with which the latch elements engage when the fastener elements engage with one another at the second point in the second loop.

11. The halter according to claim 10 wherein the slots are deeply recessed to accommodate the thumb and forefinger of one hand, so that the latch elements can be displaced against the bias of the biasing means by pinching the latch elements together with the thumb and forefinger of the one hand.

12. The halter according to claim 10 wherein the tenon is bifurcated into a pair of elongated, spaced parallel arms, which are resiliently flexible over the length thereof, and have outturned dogs on the relatively forward end portions thereof, the dogs being curved at the outside edges thereof, to react with the wall of the mortise under the resiliency of the arms, and the curvature of the edges increasing as the dogs progress toward the forward ends of the arms, to accelerate the rate of relative reciprocation between the fastener elements as they disengage from one another at the first point in the second loop.

13. The halter according to claim 1 wherein the fastener means are operatively disposed in the second loop on one flank of the animal's poll.

14. In a halter for an animal whose body has a relatively angular head thereon, and ears adjacent the apex of the same, the head comprising a snout which projects relatively forwardly of the ears, a poll which is disposed relatively behind the ears, and a jaw which interconnects the snout and poll at the bight of the animal's head, the halter comprising flexible strap material which is formed into a pair of first and second loops that are adapted to be encircled about the animal's snout and poll, respectively, the second loop being alternately openable and closeable and operatively interconnected with the first loop, crosswise of the jaw, so that when the second loop is opened, the halter can be removed from the animal's head in the direction relatively forwardly of its snout, and the second loop being in two parts and closeable by fastener means which are positioned between the parts and manually releaseable to reopen the loop when the user desires to remove the halter from the animal's head, the improvement wherein:

the fastener means include a pair of male/female fastener elements that are reciprocable in relation to one another, circumferentially of the second loop, to and from a first point therein, and cooperatively engageable and disengageable with and from one another, to close and open the second loop, respectively, when the elements are reciprocated in relation to one another between the aforesaid first point therein, and a second point therein, spaced apart from the first point, circumferentially of the second loop, and there are dual manually releaseable latch means in the second loop which are yieldably biased to interlock the fastener elements against reciprocation in relation to one another when the elements engage with one another at the second point in the second loop, and means for releasing the latch means by the application of direct manual force to the same, including oppositely disposed slots in the female fastener element, which open to the outside of the female fastener element, opposite the latch means, and are deeply recessed to accommodate the thumb and forefinger of one hand, so that the latch means can be displaced against the bias thereon by pinching the latch means together with the thumb and forefinger of the one hand.

15. The halter according to claim 14 further comprising drive means including yieldable biasing means which are responsive to release of the latch means at the second point in the second loop to reciprocate the fastener elements in relation to one another from the second point to the first point in the second loop, and means for accelerating the rate of relative reciprocation between the fastener elements when they reciprocate in relation to one another from the second point to the first point in the second loop, so that one fastener element is ejected from the other, into the open, ambient atmosphere about the halter, when the fastener elements disengage from one another at the first point in the second loop.

16. A halter for equine, bovine and other animals, comprising:

a noseband positionable to encircle the animal's nose;

left and right cheek ring members;

a throat band, positionable to extend generally under the animal's throat, and attached by one end to said left ring member and by an opposite end to said right ring member;

left and right cheek bands positionable on opposite sides of the animal's cheeks, said left cheek band being attached by one end to said noseband and by an opposite end to said left ring member, and said right cheek band being attached by one end to said noseband and by an opposite end to said right ring member;

a throat connection attached by one end to said throat and by an opposite end to said noseband;

a manually operable, quick-release snap fastener having a first member and a mating second member, said first and second members being lockable together against release under normal forces encountered during usage of the halter when connected together and quickly disconnectable from each other by the user with slight hand pressure, one of said first or second fastener members being an open ended body having a cavity and the other of said first or second fastener members having a pair of resilient arms insertable into said by the user, each said resilient arm having a laterally outward projecting catch, said cavity being sized to receive said resilient arms therewithin in sliding engagement with a pair of body sidewalls, said sidewalls being spaced apart to apply an inward force on said resilient arms to move said resilient arms toward each other as said resilient arms are being inserted into said cavity, said body sidewalls each having a sidewall latch opening and an associated latch wall portion, each said latch opening being positioned and sized to receive one or the other of said catches and permit the corresponding one of said resilient arms to move away from the other and each said latch wall portion being positioned to be latchably engaged by one or the other of said catches when said resilient arms are fully inserted into said cavity, said resilient arms biasing said catches outward into said sidewall openings in latching engagement with said latch wall portions to prevent unintentional withdrawal of said resilient arms from said cavity, said resilient arms being inwardly movable by the user to disengage said catches from said latch wall portions for withdrawal of said resilient arms from said cavity by the user simultaneously applying an inward force at said sidewall opening on both of said resilient arms, whereby only inward pressure on the resilient arms is required to release the quick-release snap fastener; and a crown strap positionable over the animal's poll, said crown strap having first and second strap pieces, said first strap piece having one end portion thereof pivotally reeved about said first fastener member and an opposite end attached to a center bar of a slip fastener, said one end portion of said first trap piece extending generally from said first fastener member through a first opening of said slip fastener to one side of said center bar, thence over said center bar, thence through a second opening of said slip fastener to the opposite side of said center bar, and then terminating at said right ring member, said strap one end portion forming an adjustable length loop between said slip fastener and said right ring member, said slip fastener being slidable along said strap one end portion to an infinitely variable position within the available range of positions when said first strap piece is not under the normal tension encountered during usage of the halter to adjustably and selectively increase or decrease the length of said loop to decrease or increase, respectively, the overall length of said first strap piece, said slip fastener being restrained on said strap one end portion against sliding when said first strap piece is under the normal tension encountered during usage of the halter, said second strap piece having one end attached to said second fastener member and an opposite end attached to said left ring member, whereby the overall length of said crown strap can be adjustably selected to precisely fit the animal without the need for adjustment holes in said crown strap for a tongue pin and without loose strap ends, and the halter can be quickly released by the user for removal from the animal.

17. A halter for equine, bovine or other animals, comprising:

a noseband positionable to encircle the animal's nose;

left and right cheek ring members;

a throat band positionable to extend generally under the animal's throat, and attached by one end to said left ring member and by an opposite end to said right ring member, left and right cheek bands positionable on opposite sides of the animals cheeks, said left cheek band being attached by one end to said noseband and by an opposite end to said left ring member, and said right cheek band being attached by one end to said noseband and by an opposite end to said right ring member;

a throat connector attached by one end to said throat band by an opposite end to said noseband;

a manually operable, quick-release fastener having a first member and a second member, said first and second members being lockable together against release under normal forces encountered during usage of the halter when connected together and quickly disconnectable from each other by the user with slight hand pressure;, and a crown strap positionable over the animal s poll, said crown strap having first and second strap pieces, said first strap piece having one end attached to said first fastener member and an opposite end attached to a center bar of a slip fastener, said first strap piece having a mid-portion extending generally from said one end attached to said first fastener member through a first opening of said slip fastener to one side of said center bar, over said center bar, through a second opening of said slip fastener to an opposite side of said center bar, through one of said left and right ring members and terminating at said opposite end attached to said center bar, said strap mid-portion forming an adjustable length loop between said slip fastener and said one left or right ring member, said slip fastener being slidable along said strap mid-portion to an infinitely variable position within the available range of positions when said first strap piece is not under the normal tension encountered during usage of the halter to adjustably and selectively increase or decrease the length of said loop to decrease or increase, respectively, the overall length of said first strap piece, said slip fastener being restrained on said strap mid-portion against sliding when said first strap piece is under the normal tension encountered during usage of the halter, said second strap piece having one end attached to said second fastener member and an opposite end attached to the other of said left or right ring members, whereby the overall length of said crown strap can be adjustably selected to precisely fit the animal without the need for adjustment holes in said crown strap for a tongue pin and without loose strap ends.

18. A halter for equine, bovine or other animals, comprising:

a noseband positionable to encircle the animal's nose;

left and right cheek ring members;

a throat and positionable to extend generally under the animal's throat, and attached by one end to said left ring member and by an opposite end to said ring member;

left and right cheek bands, positionable on opposite sides of the animal's cheeks, said left cheek band being attached by one end to said noseband and by an opposite end to said left ring member, and said right cheek band being attached by one end to said noseband and by an opposite end to said right ring member;

a throat connector attached by one end to said throat band and by an opposite end to said noseband;

a manually operable, quick-release snap fastener having a first member and a mating second member, said first and second members being lockable together against release under normal forces encountered during usage of the halter when connected together and quickly disconnectable from each other by the user with slight hand pressure; and a crown strap positionable over the animal's poll, said crown strap having first and second strap pieces, said first strap piece having one end portion thereof pivotally reeved about said first fastener member and an opposite end attached to a manually operable adjustable strap fastener, said one end portion of said first strap piece extending generally from said first fastener member through said strap fastener and then terminating at one of said left and right ring members, said strap fastener being adjustably movable along said strap one end portion to a desired position and selectively, immovably attached thereat to said strap one end portion, said strap one end portion forming an adjustable length loop between said strap fastener and said one ring member, movement of said strap fastener along said strap one end portion adjustably and selectively increasing or decreasing the length of said loop to decrease or increase, respectively, the overall length of said first strap piece by a desired amount, said second strap piece having one end attached to said second fastener member and an opposite end attached to the other of said left and right ring members.

19. A halter for equine, bovine or other animals, the halter having left and right ring members and a crown strap, the improvement wherein said crown strap includes manually operable, quick-release snap fastener having a first member and a mating second member, said first and second members being lockable together against release under normal forces encounter during usage of the halter when connected together and quickly disconnectable from each other by the user with slight hand pressure, and wherein said crown strap includes first and second strap pieces, said first strap piece having a first end attached to one of said first fastener member and the right ring member and an opposite second end attached to a center bar of a slip fastener, said first strap piece having a mid-portion extending generally from said first end through a first opening of said slip fastener to one side of said center bar, over said center bar, through a second opening of said slip fastener to an opposite side of said center bar, looped through an opening in said first fastener member and the right ring member to which said first strap end is attached and terminating at said opposite second end, said strap mid-portion forming an adjustable length loop and said slip fastener being slidable along said strap mid-portion to an infinitely variable position within the available range of positions when said first strap piece is not under the normal tension encounter during usage of the halter to adjustably and selectively increase or decrease the length of said loop to decrease or increase, respectively, the overall length of said first strap piece, said slip fastener being restrained on said strap mid-portion against sliding when said first strap piece is under the normal tension encountered during usage of the halter, said second strap piece having one end attached to said second fastener member and an opposite end attached to said left ring member, whereby the overall length of said crown strap can be adjustably selected to precisely fit the animal without the need for adjustment holes in said crown strap for a tongue pin and without loose strap ends, and the halter can be quickly released by the user for removal from the animal.

20. In a halter for animal whose body has a relatively angular head thereon, and ears adjacent the apex of the same, the head comprising a snout which projects relatively forward of the ears, a poll which is disposed relatively behind the ears, and a jaw which interconnects the snout and poll at the bight of the animal's head, the halter comprising flexible strap material which is formed into a pair of first and second loops that are adapted to be encircled about the animal's snout and poll, respectively, the second loop being alternately openable and closeable and operatively interconnected with the first loop, crosswise of the jaw, so that when the second loop is opened, the halter can be removed from the animal's head in the direction relatively forwardly of its snout, and the second loop being in two parts and closeable by fastener means which are positioned between the parts and manually releaseable to reopen and the loop when the user desires to remove the halter from the animal's head, the improvement wherein:

one part of the second loop has means therein defining a pivot rung, and an elongated strip of strap material thereadjacent, the main body of which is continuous and uninterrupted circumferentially of the second loop, but has one end portion thereof reeved pivotally about the rung of the one part, and then folded reentrantly to a point intermediate the length of the strip, there being a three-rung slip fastener ring slideably engaged on the main body of the strip, intermediate the length thereof, and an eye on the end portion of the strip which is pivotally mounted about the center rung of the fastener ring, and the strap material of the strip being woven in serpentine fashion through the ring to capture the eye between the center rung and the interwoven portion of the strap material, so that each time the ring is slid along the length of the strip to a new site thereon, the eye is clamped between the strip and the center rung of the ring when tension is reapplied to the second loop in cinching the loop about the animal's poll, and the fastener means include a pair of male/female fastener elements that are reciprocable in relation to one another, circumferentially of the second loop, to and from a first point therein, and cooperatively engageable and disengageable with and from one another, to close and open the second loop, respectively, when the elements are reciprocated in relation to one another between the aforesaid first point therein, and a second point therein, spaced apart from the first point, circumferentially of the second loop, and there are dual manually releasable latch means in the second loop which are yieldably biased to interlock the fastener elements against reciprocation in relation to one another when the elements engage with one another at the second point to the second loop, and means for releasing the latch means by the application of direct manual force to the same, including oppositely disposed slots in the female fastener element, which open to the outside of the female fastener element, opposite the latch means, and are deeply recessed to accommodate the thumb and forefinger of one hand, so that the latch means can be displaced against the bias thereon by pinching the latch means together with the thumb and forefinger of the one hand.

21. In a halter for an animal whose body has a relatively angular head thereon, and ears adjacent the apex of the same, the head comprising a snout which projects relatively forward of the ears, a poll which is disposed relatively behind the eras, and a jaw which interconnects the snout and poll at the bight of the animal's head, the halter comprising flexible strap material which is formed into a pair of first and second loops that are adapted to be encircled about the animal's snout and poll, respectively, the second loop being alternately openable and closeable and operatively interconnected with the first loop, crosswise of the jaw, so that when the second loop is opened, the halter can be removed from the animal's head in the direction relatively forwardly of its snout, and the second loop being in two parts and closeable by fastener means which are positioned between the parts and manually releasable to reopen the loop when the user desires to remove the halter from the animal's head, the improvement wherein:

one pair of the second loop has means therein defining a pivot rung, and an elongated strip of strap material thereadjacent, the main body of which is continuous and uninterrupted circumferentially of the second loop, but has one end portion thereof reeved pivotally about the rung of the one part, and then folded reentrantly to a point intermediate the length of the strip, there being a three-rung slip fastener ring slideably engaged on the main body of the strip, intermediate the length thereof, and an eye on the end portion of the strip which is pivotally mounted about the center rung of the fastener ring, and the strap material of the strip being woven in serpentine fashion through the ring to capture the eye between the center rung and the interwoven portion of the strap material, so that each time the ring is slid along the length of the strip to a new site thereon, the eye is clamped between the strip and the center rung of the ring when tension is reapplied to the second loop in cinching the loop about th animal's poll, and the fastener means include a pair of male/female fastener elements that are reciprocable in relation to one another, circumferentially of the second loop, to and from a first point therein, and cooperatively engageable and disengageable with and from one another, to close and open the second loop, respectively, when the elements are reciprocated in relation to one another between the aforesaid first point therein, and a second point therein, spaced apart from the first point, circumferentially of the second loop, and there are manually releaseable latch means in the second loop which are operable to interlock the fastener element against reciprocation in relation to one another when the elements engage with one another at the second point in the second loop, drive means including yieldably biasing means which are responsive to release of the latch means at the second point in the loop to reciprocate the fastener elements in relation to one another from the second point to the first point in the second loop, and means for accelerating the rate of relative reciprocation between the fastener elements when they reciprocate in relation to one another from the second point to the first point in the second loop, so that one fastener element is ejected from the other, into the open, ambient atmosphere about the halter, when the fastener elements disengage from one another at the first point in the second loop.

* * * * *

UNITED STATES PATENT AND TRADEMARK OFFICE

CERTIFICATE OF CORRECTION

PATENT NO. : 4,852,336

DATED : Aug. 1, 1989

INVENTOR(S) : Gammill, Floyd M.

It is certified that error appears in the above-identified patent and that said Letters Patent is hereby corrected as shown below:

Claim 1, line 16 of Column 10, delete "an" and substitute --and--.

Claim 16, line 24 of Column 13, delete "connection" and substitute --connector--.

Claim 16, line 36 of Column 13, before "by the user" insert --cavity--.

Claim 16, line 2 of Column 14, delete "trap" and substitute --strap--.

Claim 16, line 47 of Column 14, before "by an opposite end" insert --and--.

Claim 18, line 25 of Column 15, delete "and" and substitute --band--.

Claim 18, line 29 of Column 15, delete ",".

Claim 19, line 7 of Column 16, delete "encounter" and substitute --encountered--.

Claim 19, line 27 of Column 16, delete "encounter" and substitute --encountered--.

Claim 20, line 42 of Column 16, before "animal whose body" insert --an--.

Claim 20, line 59 of Column 16, delete "and".

UNITED STATES PATENT AND TRADEMARK OFFICE

CERTIFICATE OF CORRECTION

PATENT NO. : 4,852,336

DATED : Aug. 1, 1989

INVENTOR(S) : Gammill, Floyd M.

It is certified that error appears in the above-identified patent and that said Letters Patent is hereby corrected as shown below:

Claim 21, line 45 of Column 18, delete "yieldably" and substitute --yieldable--.

Signed and Sealed this

Twenty-first Day of August, 1990

*Attest:*

HARRY F. MANBECK, JR.

*Attesting Officer*

*Commissioner of Patents and Trademarks*